US008695899B2

(12) United States Patent
Maragliulo

(10) Patent No.: US 8,695,899 B2
(45) Date of Patent: Apr. 15, 2014

(54) FUEL INJECTOR

(75) Inventor: Marco Maragliulo, Empoli (IT)

(73) Assignee: Continental Automotive GmbH, Hannover (DE)

( * ) Notice: Subject to any disclaimer, the term of this patent is extended or adjusted under 35 U.S.C. 154(b) by 985 days.

(21) Appl. No.: 12/504,795

(22) Filed: Jul. 17, 2009

(65) Prior Publication Data

US 2010/0025501 A1 Feb. 4, 2010

(30) Foreign Application Priority Data

Jul. 29, 2008 (EP) ..... 08013614

(51) Int. Cl.
*F02M 61/20* (2006.01)

(52) U.S. Cl.
USPC ..... 239/533.9; 239/5; 239/533; 239/584; 239/533.13; 239/533.2; 251/54

(58) Field of Classification Search
USPC ..... 239/533.9, 584, 533.13, 290, 533.2, 239/533.7, 585.1–585.5; 251/54
See application file for complete search history.

(56) References Cited

U.S. PATENT DOCUMENTS

| | | | | |
|---|---|---|---|---|
| 4,646,975 | A * | 3/1987 | Horn | 239/585.3 |
| 6,889,913 | B2 * | 5/2005 | Ruehle et al. | 239/102.2 |
| 2006/0202049 | A1 * | 9/2006 | Miller | 239/5 |

FOREIGN PATENT DOCUMENTS

| | | | | |
|---|---|---|---|---|
| DE | 10233101 | A1 | 1/2004 | |
| DE | 10248831 | A1 | 4/2004 | |
| DE | 102006017034 | * | 10/2007 | F02M 51/06 |
| DE | 102006017034 | A1 | 10/2007 | |
| EP | 0184124 | A1 | 6/1986 | |
| EP | 1467088 | A1 | 10/2004 | |
| WO | WO2004/016935 | A1 | 2/2004 | |
| WO | WO2007/116007 | A1 * | 10/2007 | F02M 51/06 |

OTHER PUBLICATIONS

European Search Report, Application No. 08013614.6-2311. 5 pages, Jan. 14, 2009.

* cited by examiner

*Primary Examiner* — Jason Boeckmann
*Assistant Examiner* — Joel Zhou
(74) *Attorney, Agent, or Firm* — King & Spalding L.L.P.

(57) ABSTRACT

A fuel injector has a housing with a central longitudinal axis having a first cavity and may be coupled to a fuel rail having a fluid inlet portion and outlet portion. The fuel injector has a valve needle arranged at least partly within the housing axially movable in the first cavity facing the fluid outlet portion, the valve needle preventing a fluid flow through the fluid outlet portion in a closing position and releasing it through the fluid outlet portion in further positions. The fuel injector has a spring arranged within the first cavity for exerting a spring force on the valve needle along the central longitudinal axis for preventing the fluid flow through the fluid outlet portion. Additionally, the fuel injector has an adjusting element for adjusting an axial position regarding the central longitudinal axis of a spring rest depending on a pressure acting on the adjusting element.

23 Claims, 2 Drawing Sheets

FUEL INJECTOR

CROSS-REFERENCE TO RELATED APPLICATIONS

This application claims priority to EP Patent Application No. 08013614 filed Jul. 29, 2008, the contents of which is incorporated herein by reference in its entirety

TECHNICAL FIELD

The invention relates to a fuel injector.

BACKGROUND

Fuel injectors are in widespread use, in particular for internal combustion engines where they may be arranged in order to dose fluid into an intake manifold of the internal combustion engine or directly into the combustion chamber of a cylinder of the internal combustion engine.

Fuel injectors are manufactured in various forms in order to satisfy the various needs for the various combustion engines. Therefore, for example, their length, their diameter, and also various elements of the fuel injector being responsible for the way the fluid is dosed may vary in a wide range. In addition to that, fuel injectors may accommodate an actuator for actuating a needle of the fuel injector, which may, for example, be an electromagnetic actuator or a piezoelectric actuator.

In order to enhance the combustion process in view of the creation of unwanted emissions, the respective fuel injector may be suited to dose fluids under very high pressures. The pressures may be in the case of a gasoline engine in the range of up to 200 bar and in the case of a diesel engine in the range of up to 2 000 bar, for example.

SUMMARY

According to various embodiments, a fuel injector can be created which facilitates a reliable and precise operation.

According to an embodiment, a fuel injector may comprise a housing having a central longitudinal axis comprising a first cavity and being adapted to be coupled to a fuel rail having a fluid inlet portion and a fluid outlet portion, a valve needle being arranged at least partly within the housing axially movable in the first cavity facing the fluid outlet portion, the valve needle preventing a fluid flow through the fluid outlet portion in a closing position and releasing the fluid flow through the fluid outlet portion in further positions, a spring being arranged within the first cavity being adapted to exert and arranged for exerting a spring force on the valve needle along the central longitudinal axis in such a way as to contribute to prevent the fluid flow through the fluid outlet portion, and an adjusting element being adapted to adjust and arranged for adjusting an axial position regarding the central longitudinal axis of a spring rest of the spring depending on a pressure acting on the adjusting element.

According to a further embodiment, the adjusting element may be ring-shaped being at least partly formed as a hollow body comprising a second cavity. According to a further embodiment, the adjusting element can be hermetically sealed. According to a further embodiment, the second cavity of the adjusting element can be filled with gas. According to a further embodiment, the adjusting element may comprise spring steel. According to a further embodiment, a cross section of the adjusting element may comprise a larger outer diameter at at least one of a first axial end area and a second axial end area of the adjusting element than at an intermediate part of the adjusting element being arranged between the first axial end area and the second axial end area of the adjusting element. According to a further embodiment, a cross section of the adjusting element may comprise a smaller outer diameter at least one of a first axial end area and a second axial end area of the adjusting element than at an intermediate part of the adjusting element being arranged between the first axial end area and the second axial end area of the adjusting element. According to a further embodiment, the adjusting element with a central rotational axis may comprise a first side part facing the central rotational axis and a second side part facing away from the central rotational axis, the first side part comprising a top first side part and a bottom first side part regarding the central rotational axis and the second side part comprising a top second side part and a bottom second side part regarding the central rotational axis, wherein the top first side part and the bottom first side part are converging to a first circular edge and the top second side part and the bottom second side part are converging to a second circular edge. According to a further embodiment, the adjusting element may comprise its largest inner diameter at least one of the first circular edge and its smallest outer diameter at the second circular edge. According to a further embodiment, the adjusting element may comprise its smallest inner diameter at least one of the first circular edge and its largest outer diameter at the second circular edge. According to a further embodiment, the first circular edge can be arranged with an axial offset to the second circular edge regarding the central rotational axis. According to a further embodiment, the top first side part may be parallel to at least one of the bottom second side part and the bottom first side part is parallel to the top second side part. According to a further embodiment, the adjusting element can be coupled to a calibration tube. According to a further embodiment, the adjusting element can be coupled to the spring facing a first spring rest of the spring, which faces the fluid inlet portion. According to a further embodiment, the adjusting element can be fixed to a part of the fuel injector. According to a further embodiment, the adjusting element can be fixed to the spring.

BRIEF DESCRIPTION OF THE DRAWINGS

Exemplary embodiments are explained in the following with the aid of schematic drawings. These are as follows.

Elements of the same design and function that appear in different illustrations are identified with a same reference characters.

DETAILED DESCRIPTION

Figure 1:
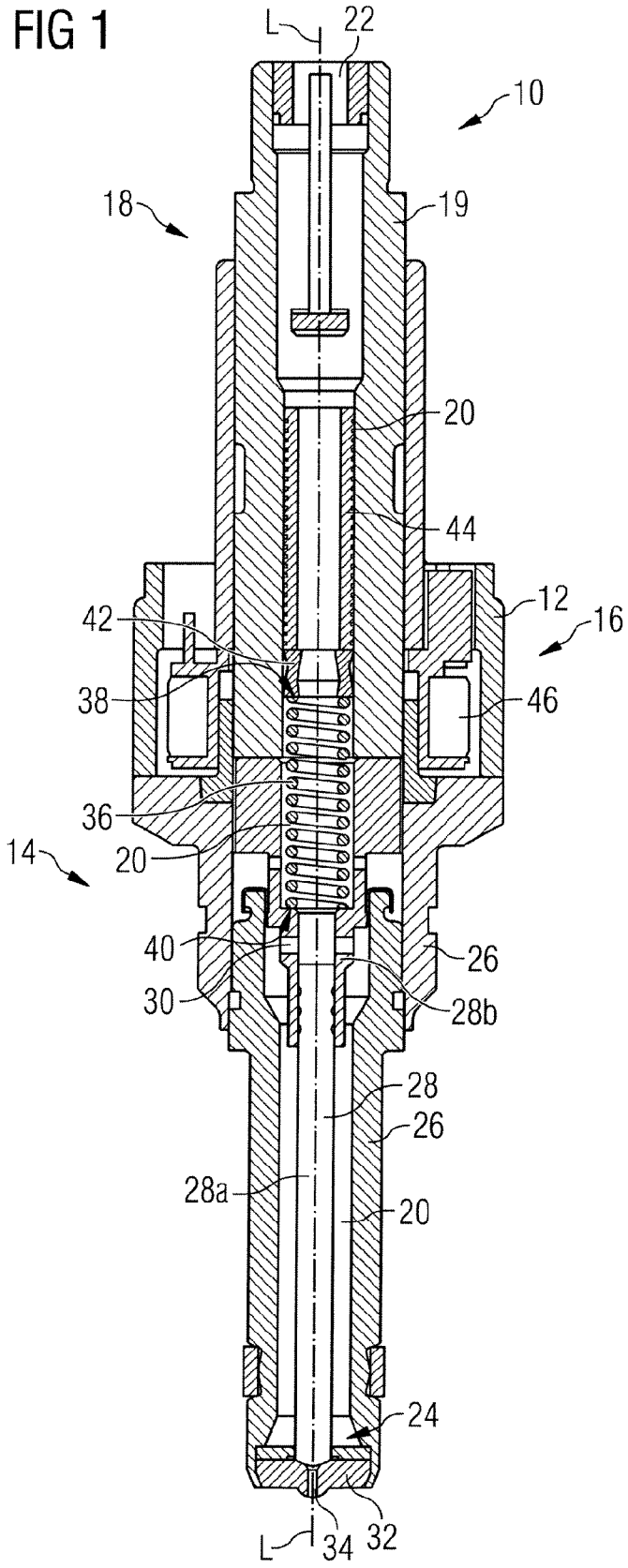
FIG. 1 a fuel injector in a longitudinal section view.

According to various embodiments, a fuel injector may comprise a housing having a central longitudinal axis comprising a first cavity and being adapted to be coupled to a fuel rail having a fluid inlet portion and a fluid outlet portion. Furthermore, the fuel injector comprises a valve needle being arranged at least partly within the housing axially movable in the first cavity facing the fluid outlet portion, the valve needle preventing a fluid flow through the fluid outlet portion in a closing position and releasing the fluid flow through the fluid outlet portion in further positions. Moreover, the fuel injector comprises a spring being arranged within the first cavity being adapted to exert and arranged for exerting a spring force on the valve needle along the central longitudinal axis in such a way as to contribute to prevent the fluid flow through the fluid outlet portion. In addition, the fuel injector comprises an adjusting element being adapted to adjust and arranged for adjusting an axial position regarding the central longitudinal axis of a spring rest of the spring depending on a pressure acting on the adjusting element. Thus, a working flow range of the fuel injector can be increased. The fuel injector can be of an outward opening type or an inward opening type. For example in the case of an inward opening type of the fuel injector, the adjusting element can decrease its axial dimensions at increasing outer pressure. Thus, the axial position of one of the two spring rests of the spring can be adjusted. The spring can increase its length and a part of the spring load can be compensated. For example in the case of an outward opening type of the fuel injector, the adjusting element can increase its axial dimensions at increasing outer pressure. Thus, the axial position of one spring rest of the spring can be adjusted. Therefore, the adjusting element enables low closing times of the needle, for example at low outer pressure, and therewith low minimum flow through the fluid outlet portion due to no changes in axial dimensions of the adjusting element at low pressure. Thus, a better atomization of the fuel compared to a fuel injector without the adjusting element can be enabled. Furthermore, in case of an inward opening type of injector, the adjusting element enables less spring load at high pressure. Thus, the fuel injector can open at a higher maximum pressure than a fuel injector without the adjusting element. Therefore, a reliable and precise operation of the fuel injector is enabled.

In case of an inward opening type of the fuel injector, the adjusting element may be adapted to decrease its axial length depending on a difference between the outer and an inner pressure of the adjusting element.

In an embodiment the adjusting element is ring-shaped being at least partly formed as a hollow body comprising a second cavity. Thus, a simple and precise coupling of the adjusting element to further parts of the fuel injector such as the spring is enabled. For example, the fuel flows through the adjusting element. Preferably, the adjusting element is a rotational solid regarding its longitudinal axis.

In a further embodiment the adjusting element is hermetically sealed.

Thus, a reliable adjusting of the axial position of the spring rest of the spring depending on outer pressure acting on the adjusting element is enabled. For example, a reliable compensation of a part of the spring load is enabled. For instance, the adjusting element has an inner pressure of about 1 bar and an outer pressure of about 20-200 bar.

In a further embodiment the second cavity of the adjusting element is filled with gas.

Thus, a reliable adjusting of the axial position of the spring rest of the spring depending on a difference between outer and inner pressure of the adjusting element is enabled. By this, an inner pressure of the adjusting element is selectable, for example about 1 bar, to enable a reliable operation of the adjusting element. For example, the adjusting element is filled with air or nitrogen.

In a further embodiment the adjusting element comprises spring steel.

Thus, a high restoring force of the adjusting element can be provided. Therefore, a reliable adjusting of the axial position of the spring rest of the spring depending on pressure acting on the adjusting element is enabled. For instance, a reliable compensation of a part of the spring load is enabled.

In a further embodiment a cross section of the adjusting element comprises a larger outer diameter at a first axial end area and/or a second axial end area of the adjusting element than at an intermediate part of the adjusting element being arranged between the first axial end area and the second axial end area of the adjusting element.

Thus, the adjusting element can adjust its axial dimensions such as its axial length in a simple and reliable way. For example, the adjusting element is enabled to decrease its axial length in case of increasing outer pressure acting on it in a simple way. Thus, the adjusting element is enabled to adjust the axial position of the spring rest of the spring in a simple and reliable way. For instance, the adjusting element is shaped concave.

In a further embodiment a cross section of the adjusting element comprises a smaller outer diameter at a first axial end area and/or a second axial end area of the adjusting element than at an intermediate part of the adjusting element being arranged between the first axial end area and the second axial end area of the adjusting element.

Thus, the adjusting element can adjust its axial dimensions such as its axial length in a simple and reliable way. For example, the adjusting element is enabled to increase its axial length in case of increasing outer pressure acting in a simple way. For instance, the adjusting element is shaped convex. Thus, the adjusting element is enabled to adjust the axial position of the spring rest of the spring in a simple and reliable way.

In a further embodiment the adjusting element with a central rotational axis comprises a first side part facing the central rotational axis and a second side part facing away from the central rotational axis, the first side part comprising a top first side part and a bottom first side part regarding the central rotational axis and the second side part comprising a top second side part and a bottom second side part regarding the central rotational axis, wherein the top first side part and the bottom first side part are converging to a first circular edge and the top second side part and the bottom second side part are converging to a second circular edge.

Thus, the adjusting element can adjust its axial dimensions such as its axial length in an especially simple and reliable way. Thus, the adjusting element is enabled to adjust the axial position of the spring rest of the spring in a simple and reliable way.

In a further embodiment the adjusting element comprises its largest inner diameter at the first circular edge and/or its smallest outer diameter at the second circular edge.

Thus, the adjusting element can adjust its axial dimensions such as its axial length in an especially simple and reliable way, for example in case of an inward opening type of the fuel injector. Thus, the adjusting element is enabled to adjust the axial position of the spring rest of the spring in a simple and reliable way.

In a further embodiment the adjusting element comprises its smallest inner diameter at the first circular edge and/or its largest outer diameter at the second circular edge.

Thus, the adjusting element can adjust its axial dimensions such as its axial length in an especially simple and reliable way, for example in case of an outward opening type of the fuel injector. Thus, the adjusting element is enabled to adjust the axial position of the spring rest of the spring in a simple and reliable way.

In a further embodiment the first circular edge is arranged with an axial offset to the second circular edge regarding the central rotational axis.

Thus, the adjusting element can adjust its axial dimensions such as its axial length in an especially simple and reliable way. Thus, the adjusting element is enabled to adjust the axial position of the spring rest of the spring in a simple and reliable way.

In a further embodiment the top first side part is parallel to the bottom second side part and/or the bottom first side part is parallel to the top second side part.

Thus, the adjusting element can adjust its axial dimensions such as its axial length in an especially simple and reliable way. Thus, the adjusting element is enabled to adjust the axial position of the spring rest of the spring in a simple and reliable way.

In a further embodiment the adjusting element is coupled to a calibration tube.

Thus, dynamic effects during transients and/or vibrations within the fuel injector can be limited. Moreover, the adjusting element is enabled to adjust the axial position of the spring rest of the spring in a reliable way. For example, the calibration tube is arranged at the central longitudinal axis within the first cavity, for instance facing the fluid inlet portion, and is fixed to the housing. The calibration tube may provide a fixed bond for the spring.

In a further embodiment the adjusting element is coupled to the spring facing a first spring rest of the spring, which faces the fluid inlet portion.

Thus, the adjusting element is enabled to adjust the axial position of the spring rest of the spring in a reliable way. Moreover, dynamic effects during transients and/or vibrations within the fuel injector can be limited. For example, the adjusting element is arranged between the spring and the calibration tube.

In a further embodiment the adjusting element is fixed to a part of the fuel injector.

Thus, dynamic effects during transients and/or vibrations within the fuel injector can be limited. For instance, the adjusting element is fixed to the calibration tube by laser welded spots or soldering.

In a further embodiment the adjusting element is fixed to the spring.

Thus, dynamic effects during transients and/or vibrations within the injector can be limited. For example, the adjusting element is fixed to the spring by laser welded spots or soldering.

A fuel injector 10 (FIG. 1) may be used as a fuel injection valve for a combustion chamber of an internal combustion engine and comprises a housing 12 with a valve assembly 14, an actuator unit 16 and a fuel connector 18. The fuel connector 18 is designed to be connected to a high-pressure fuel chamber of the internal combustion engine, the fuel is stored under high pressure, for example, under the pressure of about 200 bar in the case of a gasoline engine or of about 2000 bar in the case of a diesel engine.

The housing 12 with a central longitudinal axis L comprises an inlet tube 19 with a first cavity 20 which is axially led through the housing 12. The housing 12 being adapted to be coupled to a fuel rail comprises a fluid inlet portion 22 and a fluid outlet portion 24.

The housing 12 comprises a valve body 26. A valve needle 28 is arranged within the housing 12 axially movable in the first cavity 20 facing the fluid outlet portion 24. The valve needle 28 comprises an end section 28*a* and an armature 28*b*. Alternatively, the valve needle 28 may be made in one piece or the valve needle 28 may comprise further parts. The armature 28*b* is fixed to the end section 28*a* of the valve needle 28. The armature 28*b* has openings 30 which couple an upper part of the first cavity 20 and a lower part of the first cavity 20 hydraulically. The first cavity 20 and the openings 30 are parts of a main fluid line which allows a fluid flow from the fluid inlet portion 22 to the fluid outlet portion 24.

On one of the free ends of the first cavity 20 the fluid outlet portion 24 is formed which is closed or opened depending on the axial position of the valve needle 28. In a closing position of the valve needle 28 it rests sealingly on a seat 32 thereby preventing a fluid flow through at least one injection nozzle 34 in the valve body 26. The injection nozzle 34 may be for example an injection hole, but it may also be of some other type suitable for dosing fluid. The seat 32 may be made in one part with the valve body 26 or may also be a separate part from the valve body 26.

A spring 36 is arranged within the first cavity 20 and is adapted to exert and arranged for exerting a spring force on the valve needle 28 along the central longitudinal axis L in such a way as to contribute to prevent the fluid flow through the fluid outlet portion 24. The spring 36 is arranged to rest on a first spring rest 38 and a second spring rest 40, which is for example the armature 28*b* of the valve needle 28. By this, the spring 36 is mechanically coupled to the valve needle 28.

An adjusting element 42 is arranged in the first cavity 20. For example, the adjusting element 42 comprises the first spring rest 38 for the spring 36. The adjusting element 42 is adapted to adjust and arranged for adjusting an axial position regarding the central longitudinal axis L of the spring rests 38 of the spring 36 depending on a pressure acting on the adjusting element 42. Thus, a working flow range of the fuel injector 10 can be increased. For example, the adjusting element 42 can decrease its axial dimensions at increasing outer pressure. Thus, the axial position of one of the two spring rests 38, 40 of the spring 36 can be adjusted. The spring 36 can increase its length and a part of the spring load can be compensated. Therefore, the adjusting element 42 enables low closing times of the valve needle 28, for example at low outer pressure, and therewith low minimum flow through the injection nozzle 34 due to no changes in axial dimensions of the adjusting element 42 at low pressure. Thus, a better atomization of the fuel compared to a fuel injector without the adjusting element 42 can be enabled. Furthermore, the adjusting element 42 enables less spring load at high pressure. Thus, the fuel injector 10 may open at a higher maximum pressure than a fuel injector without the adjusting element 42. Therefore, a reliable and precise operation of the fuel injector 10 is enabled.

For example, the adjusting element 42 is ring-shaped and at least partly formed as a hollow body. For instance, the adjusting element 42 comprises spring steel. In this exemplary embodiment, the adjusting element 42 is arranged between a calibration tube 44 and the spring 36. For example, the adjusting element 42 is fixed to the spring 36 by laser welded spots or soldering.

The calibration tube 44 is arranged in the first cavity 20 facing the fluid inlet portion 22 and may be moved axially during the manufacturing process of the fuel injector 10 in order to preload the spring 36 in a desired way.

The fuel injector 10 is provided with a drive that is preferably an electromagnetic drive, comprising a coil 46, which is preferably extrusion-coated, the valve body 26, the armature 28*b* and the inlet tube 19 all forming an electromagnetic circuit. The armature 28*b* preferably has a large diameter compared to the diameter of the end section 28*a* of the valve needle 28. The large diameter enables a proper electromagnetic flow through the armature 28*b* which contributes to a proper controllability of the end section 28*a* of the valve needle 28.

If the coil 46 is energized, this results in an electromagnetic force acting on the valve needle 28. The electromagnetic force acts against the mechanical force obtained from the spring 36. By appropriately energizing the coil 46, the valve needle 28, in particular the end section 28*a* of the valve needle 28, may in that way be moved away from its closing position, which results in a fluid flow through the injection nozzle 34. After a predetermined time the coil 46 may be de-energized again.

The fluid may flow from the fluid inlet portion 22 through the inlet tube 19, the calibration tube 44, the adjusting element 42, the openings 30 in the armature 28*b* and the first cavity 20 to the fluid outlet portion 24. If the valve needle 28 allows a fluid flow through the fluid outlet portion 24 in an opening position, the fluid may flow through the injection nozzle 34.

Figure 2:
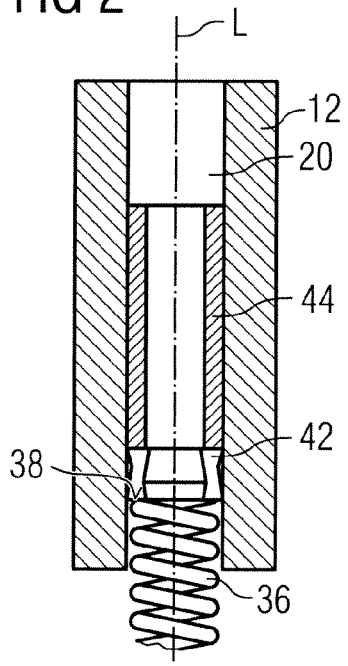
FIG. 2 a part of the fuel injector in a longitudinal section view.

FIG. 2 shows a part of the fuel injector 10 in a longitudinal section view. The housing 12 with the central longitudinal axis L comprises the first cavity 20. The adjusting element 42 is arranged between the calibration tube 44 and the spring 36 in the first cavity 20 of the housing 12. The adjusting element 42 comprises the first spring rest 38 for the spring 36.

By adjusting the axial position of the spring rest 38 of the spring 36, the adjusting element 42 is adapted for compensating a part of the spring force acting on the valve needle 28 (FIG. 1) depending on the pressure acting on the adjusting element 42 caused by the fuel flowing within the first cavity 20 of the housing 12.

Figure 3:
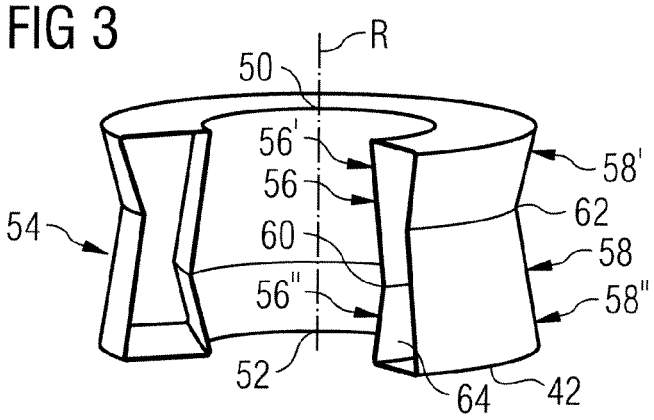
FIG. 3 an adjusting element in a first condition.

FIG. 3 shows the adjusting element 42 in a first condition that is for example without an adjusting of its axial dimensions depending on the pressure acting on it. A cross section of the adjusting element 42 comprises a larger outer diameter at a first axial end area 50 and a second axial end area 52 of the adjusting element 42 than at an intermediate part 54 of the adjusting element 42 being arranged between the first axial end area 50 and the second axial end area 52 of the adjusting element 42.

The adjusting element 42 with a central rotational axis R comprises a first side part 56 facing the central rotational axis R and a second side part 58 facing away from the central rotational axis R. The first side part 56 comprises a top first side part 56' and a bottom first side part 56" regarding the central rotational axis R. The second side part 58 comprises a top second side part 58' and a bottom second side part 58" regarding the central rotational axis R. The top first side part 56' and the bottom first side part 56" are converging to a first circular edge 60 and the top second side part 58' and the bottom second side part 58" are converging to a second circular edge 62. Preferably, the top first side part 56', the bottom first side part 56", the top second side part 58' and the bottom second side part 58" each comprise a linear basic shape being rotationally symmetric.

The adjusting element 42 comprises its largest inner diameter at the first circular edge 60 and its smallest outer diameter at the second circular edge 62. Furthermore, the first circular edge 60 is arranged with an axial offset to the second circular edge 62 regarding the central rotational axis R. Preferably, the top first side part 56' is parallel to the bottom second side part 58" and the bottom first side part 56" is parallel to the top second side part 58'. Thus, the adjusting element 42 can adjust its axial dimensions such as its axial length in an especially simple and reliable way. Moreover, the adjusting element 42 is ring-shaped and is formed as a hollow body comprising a second cavity 64 being hermetically sealed. Preferably, the second cavity 64 of the adjusting element 42 is filled with gas, for example air or nitrogen. To provide a high restoring force, the adjusting element 42 may comprise spring steel. Thus, the adjusting element 42 is enabled to adjust the axial position of one spring rest 38, 40 of the spring 36 in a simple and reliable way.

Alternatively, the cross section of the adjusting element 42 may comprise a smaller outer diameter at the first axial end area 50 and/or the second axial end area 52 of the adjusting element 42 than at the intermediate part 54 of the adjusting element 42. In that case, the adjusting element 42 may comprise its smallest inner diameter at the first circular edge 60 and/or its largest outer diameter at the second circular edge 62.

Figure 4:
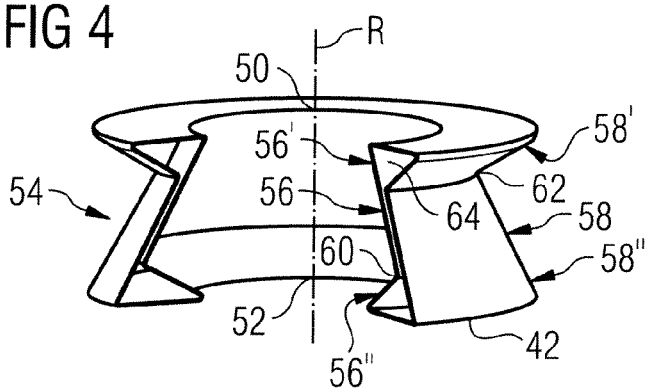
FIG. 4 the adjusting element in a second condition.

FIG. 4 the adjusting element 42 in a second condition that is for example with adjusting its axial dimensions depending on pressure acting on it. The adjusting element 42 is enabled to adjust the axial position of one spring rest 38, 40 of the spring 36. For example in case of an inward opening type of the fuel injector 10, the adjusting element 42 is adapted to decrease its axial length and therewith decrease the spring load when the outer pressure increases by adjusting the axial position of one spring rest 38, 40 of the spring 36. For example, at low pressure of about 20-40 bar, the closing time of the injection nozzle 34 (FIG. 1) maybe the same as without the adjusting element 42, for example around 400 μs, since the adjusting element 42 does not change its axial dimensions at low pressure (FIG. 3). For example at high outer pressure of about 150-200 bar, the adjusting element 42 may decrease the spring load by adjusting its axial length, and therewith increase a net force acting on the valve needle 28 (FIG. 1). Thus, the maximum possible pressure at which the valve needle 28 opens against the hydraulic force increases, for example to more than 200 bar. Therefore, the fuel injector 10 is able to work at higher pressure compared to a fuel injector without the adjusting element 42. Alternatively, the adjusting element 42 may be arranged and adjusted in such a way that the maximum possible pressure at which the valve needle 28 opens is the same as without the adjusting element 42. Then, the spring load at low pressure can be increased and consequently the closing time can be decreased, for example to less than 400 μs. Therefore, the minimum flow through the injection nozzle 34 (FIG. 1) can be decreased compared to a fuel injector without the adjusting element 42. Thus, a better atomization of the fuel compared to a fuel injector without the adjusting element 42 can be enabled. Also, a trade-off between the two alternatives may be possible.

For instance, the adjusting element 42 has an axial length of about 2-5 mm (FIG. 3) and shortens its axial length (FIG. 4) in case of an inward opening type of the fuel injector 10 from without pressure to high pressure of about 0.3-1 mm to adjust the axial position of one spring rest 38, 40 of the spring 36. For example, 30% of the spring load may be unloaded by the adjusting element 42.

The invention is not restricted by the explained embodiments. For example, the adjusting element 42 may comprise a different shape or may be arranged at a different place within the fuel injector 10. Furthermore, the housing 12 and/or the valve needle 28 may comprise a different shape.

What is claimed is:

1. A fuel injector comprising: a housing having a central longitudinal axis, a first cavity, a fluid inlet portion, and a fluid outlet portion with a valve seat; a valve needle arranged at least partly within the housing axially movable in the first cavity; the valve needle sealingly resting on the valve seat in a closing position to prevent a fluid flow through the fluid outlet portion and releasing the fluid flow through the fluid outlet portion in further positions; a spring arranged within the first cavity and mechanically coupled to the valve needle and to a spring rest in such fashion that it is operable to exert a spring force on the valve needle for pressing the valve needle against the valve seat; and an adjusting element including the spring rest and having an internal pressure and an axial length measured along the central longitudinal axis of the housing; the adjusting element defining a cross section taken at an intermediate location disposed between a first axial end and a second axial end of the adjusting element, the cross section smaller in area compared to a cross-sectional area of at least one of the axial ends of the adjusting element; the adjusting element having a central rotational axis and comprises a first side part facing the central rotational axis and a second side part facing away from the central rotational axis, the first side part comprising a first top portion and a first bottom portion regarding the central rotational axis; and the second side part comprising a second top portion and a second bottom portion regarding the central rotational axis; wherein the first top portion and the first bottom portion converge continuously from the first and second axial end area, respectively, to a first circular edge and the second top portion and the second bottom portion converge continuously from the first and second axial end area, respectively, to a second circular edge; wherein the axial position of the spring rest is defined by the axial length of the adjusting element and the axial length of the adjusting element varying depending at least in part on a difference between the internal pressure of the adjusting element and a fluid pressure inside the housing.

2. The fuel injector according to claim 1, wherein the adjusting element is ring-shaped being at least partly formed as a hollow body comprising a second cavity.

3. The fuel injector according to claim 2, wherein the adjusting element is hermetically sealed.

4. The fuel injector according to claim 2, wherein the second cavity of the adjusting element is filled with gas.

5. The fuel injector according to claim 1, wherein the adjusting element comprises spring steel.

6. The fuel injector according to claim 1, further comprising a cross section of the adjusting element taken at an intermediate location disposed between a first axial end and a second axial end, the cross section larger in area compared to a cross-sectional area of at least one of the axial ends of the adjusting element.

7. The fuel injector according to claim 1, wherein the adjusting element comprises its largest inner diameter at the first circular edge and its smallest outer diameter at the second circular edge.

8. The fuel injector according to claim 1, wherein the adjusting element comprises its smallest inner diameter at the first circular edge and its largest outer diameter at the second circular edge.

9. The fuel injector according to claim 1, wherein the first circular edge is arranged with an axial offset to the second circular edge regarding the central rotational axis.

10. The fuel injector according to claim 1, wherein the first top portion is parallel to the second bottom portion and the first bottom portion is parallel to the second top portion.

11. The fuel injector according to claim 1, wherein the adjusting element is coupled to a calibration tube arranged in the first cavity.

12. The fuel injector according to claim 1, wherein the adjusting element is coupled to the spring facing a first spring rest of the spring, which faces the fluid inlet portion.

13. The fuel injector according to claim 1, wherein the adjusting element is fixed to a part of the fuel injector.

14. The fuel injector according to claim 1, wherein the adjusting element is fixed to the spring.

15. A method for operating a fuel injector comprising the steps of: providing a housing having a central longitudinal axis, a fluid inlet portion, and a fluid outlet portion with a valve seat, the housing including a first cavity, coupling the housing to a fuel rail, arranging a valve needle at least partly within the housing, the valve needle axially movable in the first cavity between a closing position and further positions, the valve needle sealingly resting on the valve seat in the closing position to prevent a fluid flow through the fluid outlet portion and releasing the fluid flow through the fluid outlet portion in the further positions, exerting a spring force by a spring disposed within the first cavity and mechanically coupled to the valve needle and to a spring rest on the valve to bias the valve needle toward the valve seat, and adjusting an axial position of the spring rest by means of changing axial dimensions of an adjusting element depending on a pressure difference between an internal pressure of the adjusting element and an external pressure acting on the adjusting element, wherein, in the case of an inward opening type of the fuel injector, the adjusting element decreases its axial dimensions at increasing pressure difference and, in the case of an outward opening type of the fuel injector, the adjusting element increases its axial dimensions at increasing pressure difference, and wherein the adjusting element defining a cross section taken at an intermediate location disposed between a first axial end and a second axial end of the adjusting element, the cross section smaller in area compared to a cross-sectional area of at least one of the axial ends of the adjusting element; the adjusting element having a central rotational axis and comprises a first side part facing the central rotational axis and a second side part facing away from the central rotational axis, the first side part comprising a first top portion and a first bottom portion regarding the central rotational axis; and the second side part comprising a second top portion and a second bottom portion regarding the central rotational axis; wherein the first top portion and the first bottom portion converge continuously from the first and second axial end area respectively, to a first circular edge and the second top portion and the second bottom portion converge continuously from the first and second axial end area, respectively, to a second circular edge.

16. The method according to claim 15, wherein the adjusting element is hermetically sealed.

17. The method according to claim 15, wherein the adjusting element includes a second cavity containing a gas.

18. The method according to claim 15, wherein a cross section of the adjusting element comprises a larger outer diameter at least one of a first axial end area and a second axial end area of the adjusting element than at an intermediate part of the adjusting element being arranged between the first axial end area and the second axial end area of the adjusting element.

19. An electromagnetic fuel injection valve comprising: a housing having a central longitudinal axis, a first cavity, a fluid inlet portion, and a fluid outlet portion with a valve seat; a valve needle disposed at least partly within the housing and axially moveable within the first cavity; the valve needle sealingly resting on the valve seat in a closing position to prevent a fluid flow through the fluid outlet portion and releasing the fluid flow through the fluid outlet portion in further positions; a spring disposed within the first cavity and mechanically coupled to the valve needle and to a spring rest; the spring exerting a force on the valve needle pressing the valve needle against the valve seat; an electromagnetic drive generating an electromagnetic force effective to move the valve needle away from the valve seat towards the fuel inlet portion and against the force exerted by the spring; and an adjusting element including the spring rest, the adjusting element having an axial length measured along the central longitudinal axis of the housing; and the adjusting element having a hollow body including a second cavity hermetically sealed and having an internal pressure; the adjusting element defining a cross section taken at an intermediate location disposed between a first axial end and a second axial end of the adjusting element, the cross section smaller in area compared to a cross-sectional area of at least one of the axial ends of the adjusting element; the adjusting element having a central rotational axis and comprises a first side part facing the central rotational axis and a second side part facing away from the central rotational axis, the first side part comprising a first top portion and a first bottom portion regarding the central rotational axis; and the second side part comprising a second top portion and a second bottom portion regarding the central rotational axis; wherein the first top portion and the first bottom portion converge continuously from the first and second axial end area, respectively, to a first circular edge and the second top portion and the second bottom portion converge continuously from the first and second axial end area, respectively, to a second circular edge; the axial length of the spring rest defined at least in part by the axial length of the adjusting element; and the adjusting element deformable by a fluid pressure inside the housing, the axial length of the adjusting element decreasing when a difference between the internal pressure in the adjusting element and the fluid pressure inside the housing increases.

20. The fuel injector according to claim 1, wherein the adjusting element further comprises two end sections and two side walls; and wherein:

one of the two end sections faces the fluid inlet portion and the other of the two end sections faces the fluid outlet portion;

one of the two side walls faces the central longitudinal axis and the other of the two side walls is remote from the central longitudinal axis;

each of the two side walls extends from one of the two end sections to the other of the two end sections; and at least one of the two side walls forms an acute angle with at least one of the two side walls.

21. The fuel injector according to claim 1,wherein the adjusting element further comprises a top section facing the fluid inlet portion, a bottom section facing the fluid outlet portion, an inner side wall facing the central longitudinal axis, and an outer side wall remote from the central longitudinal axis; and wherein:

each of the side walls extends from the top section to the bottom section, connecting the top section to the bottom section;

each of the side walls forms an acute angle with both the top section and the bottom section;

the inner side wall includes a first kink;

the outer side wall includes a second kink;

a lateral distance between the central longitudinal axis and the inner side wall increases monotonously from the top section to the first kink and from the bottom section to the first kink; and a lateral distance between the central longitudinal axis and the outer side wall decreases monotonously from the top section to the second kink and from the bottom section to the second kink.

22. The fuel injector according to claim 21, further comprising the first kink offset with respect to the second kink in the direction of the central longitudinal axis.

23. The fuel injector according to claim 1, further comprising:

a longitudinal center axis of the adjusting element, the longitudinal center axis parallel to the central longitudinal axis of the housing; and wherein the adjusting element includes a cross-sectional shape, the cross-sectional shape asymmetric with respect to the longitudinal center axis of the cross-sectional shape.

* * * * *